US006334759B1

(12) United States Patent
Kaneko et al.

(10) Patent No.: US 6,334,759 B1
(45) Date of Patent: Jan. 1, 2002

(54) CONTROL VALVE FOR VARIABLE DISPLACEMENT COMPRESSOR

(75) Inventors: Morio Kaneko; Ichiro Ohkawara, both of Saitama; Masaki Ota, Aichi; Ken Suito, Aichi; Masanori Sonobe, Aichi; Tomoji Tarutani, Aichi, all of (JP)

(73) Assignees: Kabushiki Kaisha Saginomiya Seisakusho, Tokyo; Kabushiki Kaisha Toyoda Jidoshokki Seisakusho, Kariya, both of (JP)

( * ) Notice: Subject to any disclaimer, the term of this patent is extended or adjusted under 35 U.S.C. 154(b) by 0 days.

(21) Appl. No.: 09/565,076

(22) Filed: May 4, 2000

(30) Foreign Application Priority Data

May 10, 1999 (JP) ..... 11-128361

(51) Int. Cl.[7] ..... F04B 17/04

(52) U.S. Cl. ..... 417/222.2; 417/222; 417/269; 417/313; 62/228.3

(58) Field of Search ..... 417/222, 222.2, 417/269, 313; 69/228.3

(56) References Cited

U.S. PATENT DOCUMENTS

| | | | | |
|---|---|---|---|---|
| 4,752,189 A | | 6/1988 | Bearint et al. | 417/222 |
| 4,932,843 A | | 6/1990 | Itoigawa et al. | 417/222 |
| 5,318,410 A | | 6/1994 | Kawamura et al. | 417/222.2 |
| 5,332,365 A | | 7/1994 | Taguchi | 417/222.2 |
| 6,192,699 B1 | * | 2/2001 | Kato et al. | 62/228.3 |
| 6,231,727 B1 | * | 4/2001 | Kawaguchi | 417/222.2 |

FOREIGN PATENT DOCUMENTS

| | | |
|---|---|---|
| JP | 3-53474 | 8/1991 |
| JP | 6-17010 | 5/1994 |
| JP | 8-177735 | 7/1996 |
| JP | 08177735 | 7/1996 |

OTHER PUBLICATIONS

European Search Report dated May 17, 2001.

* cited by examiner

*Primary Examiner*—Charles G. Freay
*Assistant Examiner*—Eric D. Hayes
(74) *Attorney, Agent, or Firm*—McDermott, Will & Emery

(57) ABSTRACT

A valve housing of the control valve has a communication passage communicating a suction port of the compressor with a crank chamber of the compressor. A main valve is provided in the valve housing for opening and closing the communication passage. A spring member resiliently biases the main valve toward its closed position. A pressure actuated unit moves the main valve toward the open position by receiving a suction pressure of the compressor. A flow adjustment valve is disposed in the valve housing for adjusting an open degree of a leak passage and receives the discharge pressure exerting a force on the flow adjustment valve toward its closed position. The flow adjustment valve increases a leak flow rate of a fluid flowing from a discharge port of the compressor to a crank chamber through a leak passage when the compressor provides a lower discharge pressure. A correction spring is disposed between the main valve and the flow adjustment valve. The correction spring resiliently biases a valve element of the main valve toward the open position and increases in spring force with transfer of a valve element of the flow adjustment valve toward its closed position.

5 Claims, 9 Drawing Sheets

CONTROL VALVE FOR VARIABLE DISPLACEMENT COMPRESSOR

BACKGROUND OF THE INVENTION

1. Field of the Invention

The present invention relates to a control valve for a variable displacement compressor, particular to a displacement control valve for a swash-plate-type variable displacement compressor which is applied to an on-vehicle air-conditioning unit or the like. The compressor has a devise for releasing a pressure in a crank chamber.

2. Related Art

Known displacement control valves for a swash-plate-type variable displacement compressor are disclosed in Japan patent Laid-open No. H. 3-53474, Japan Utility Model Laid-open No. H. 6-17010, and Japan patent Application Laid-open No. H. 8-177735.

The swash-plate-type variable displacement compressor having the control valve basically decreases in discharge displacement with increase of a crank chamber pressure of the compressor and increases in the displacement with the decrease of the crank chamber pressure.

The control valve opens and closes a communication passage communicating a suction port of the compressor with the crank chamber by using a valve element moving in response to a suction pressure of the compressor, thereby controlling the pressure of the crank chamber.

Furthermore, the valve element of the control valve is moved toward the open position by the discharge pressure of the compressor or by increasing a spring force of a correction spring resiliently biasing the valve element toward the open position with increase of the discharge pressure to vary the opening-closing switching point of the valve element in response to the discharge pressure. Thus, the control valve controls the discharge displacement in relation to an outer-air condition (or the discharge pressure).

Each known displacement control valve is constructed to achieve its object. However, a recent variable displacement compressor has a less leak flow rate of a fluid leaking into a crank chamber with regard to a discharge fluid in a piston/cylinder section. Thus, when the compressor provides a low discharge pressure, the crank chamber can not obtain an enough pressure for achieving a desired control performance as the displacement control valve, in which the control valve will not meet the compressor in their control performances.

Increase of the leak rate of a discharge pressure fluid leaking into the crank chamber would solve the problem in a low discharge pressure state of the compressor. However, this increases a pressure loss in a high discharge pressure state of the compressor, undesirably increasing a energy loss against an energy saving trend.

SUMMARY OF THE INVENTION

In view of the above-described disadvantage, an object of the invention is to provide an improved control valve for a swash-plate-type variable displacement compressor having a devise for releasing a pressure of a crank chamber. The improved control valve will not increase a pressure loss in a high discharge pressure state of the compressor and provides a solution of the problem in a low discharge pressure state of the compressor so as to have a control characteristic to meet with the performance of the compressor, enabling a displacement control in relation to an environmental condition.

For achieving the object, a first aspect of the invention is a control valve for variable displacement compressor which includes:

a valve housing having a communication passage communicating a suction port of the compressor with an crank chamber of the compressor, a main valve provided in the valve housing for opening and closing the communication passage, a spring member correction biasing the main valve toward its closed position, and a pressure actuated unit for moving the main valve toward its open position by receiving a suction pressure of the compressor, a flow adjustment valve disposed in the valve housing for adjusting an open degree of said leak passage and receiving the discharge pressure exerting a force on the leak flow adjustment valve toward its closed position, the leak flow adjustment valve increasing a leak flow rate of a fluid flowing from a discharge port of the compressor to a crank chamber through the leak flow adjustment valve when the compressor provides a lower discharge pressure, and a correction spring disposed between the main valve and the leak flow adjustment valve, the correction spring resiliently biasing a valve element of the main valve toward the open position, the correction spring increasing in spring force with transfer of a valve element of the leak flow adjustment valve toward the closed position.

The flow adjustment valve may be a slide valve slidingly received in a valve receiving recess formed in the valve housing and defines a leak passage between an outer surface of the leak flow adjustment valve and an inner surface the valve receiving recess, the leak passage becoming shorter with the transfer of the valve element of the leak flow adjustment valve toward its open position, adjusting a leak flow rate of a fluid flowing from the compressor discharge port to the crank chamber.

A second aspect of the invention is a control valve for variable displacement compressor comprising:

a valve housing having a communication passage communicating a suction port of the compressor with a crank chamber of the compressor, a main valve provided in the valve housing for opening and closing the communication passage, a spring member resiliently biasing the main valve toward its closed position, and a pressure actuated unit for moving the main valve toward its open position by receiving a suction pressure of the compressor, an auxiliary biasing unit disposed in the valve housing and exerting a force on the main valve toward its valve open position by a differential pressure between a discharge pressure of the compressor and a pressure of the crank chamber, a leak passage provided in said valve housing for communicating a discharge port of said compressor with said crank chamber, and a leak flow adjustment valve disposed in the valve housing for adjusting an open degree of said leak passage and receiving a discharge pressure exerting a force on the leak flow adjustment valve toward the closed position, the leak flow adjustment valve increasing a leak flow rate of a fluid flowing from a discharge port of the compressor to a crank chamber through the leak flow adjustment valve when the compressor provides a lower discharge pressure.

The leak flow adjustment valve may be a variable flow orifice valve adjusting a leak flow rate of a fluid flowing from the discharge port of the compressor to the crank chamber, the flow rate being proportional to an open rate of the leak flow adjustment valve. Alternatively, the leak flow adjustment valve may be a check valve being open when the discharge pressure of the compressor is lower than a reference pressure.

Next, an operation of each invention aspect will be discussed.

In the control valve for variable displacement compressor of the first aspect of the invention, the main valve opens and closes the communication passage in response to the suction pressure of the compressor to control the crank chamber pressure. The valve element of the leak flow adjustment valve moves toward the valve closed potion with increase of a discharge pressure, which increases the spring force of the correction spring with increase of the discharge pressure. That is, the main valve varies in its open or close starting point in response to the discharge pressure, enabling a displacement control in relation to a load according to an environmental air condition (or in relation to the discharge pressure).

Furthermore, in a lower discharge pressure state of the compressor, the leak flow adjustment valve increases a leak rate of a fluid flowing from the discharge port to the crank chamber to increase the crank chamber pressure, thereby keeping a control characteristic of the displacement control valve when the compressor is providing a low discharge pressure. The control valve characteristic readily meets the performance of the compressor.

The leak flow rate of the fluid leaking from the compressor discharge port to the crank chamber is adjusted basically proportionally to the open degree of the leak adjustment valve, adjusting the crank chamber pressure in response to the discharge pressure.

In the control valve for the variable displacement compressor of the second aspect of the invention, the main valve opens and closes the communication passage in response to the suction pressure of the compressor to control the crank chamber pressure. The force exerted on the main valve by the auxiliary biasing unit increases with increase of the discharge pressure. That is, the main valve varies in its open or close starting point in response to the discharge pressure, enabling a displacement control in relation to the discharge pressure (a load according to an environmental air condition). Furthermore, in a lower discharge pressure state of the compressor, the leak flow adjustment valve increases the rate of a leak flowing from the discharge port to the crank chamber to increase the crank chamber pressure, thereby keeping a control characteristic of the displacement control valve when the compressor is providing a low discharge pressure. The control valve characteristic readily meets the performance of the compressor.

The leak rate of the fluid leaking from the compressor discharge port to the crank chamber is adjusted proportionally to the open degree of the orifice-type leak adjustment valve. This adjusts the crank chamber pressure according to the discharge pressure.

The check valve used for the leak adjustment valve opens to adjust the crank chamber pressure when the deferential pressure between the discharge pressure and the crank chamber pressure is smaller than the reference pressure.

DETAILED DESCRIPTION OF THE PREFERRED EMBODIMENTS

Referring to the accompanied drawings, an embodiment of the present invention will be discussed hereinafter.

A First Embodiment

Figure 1:
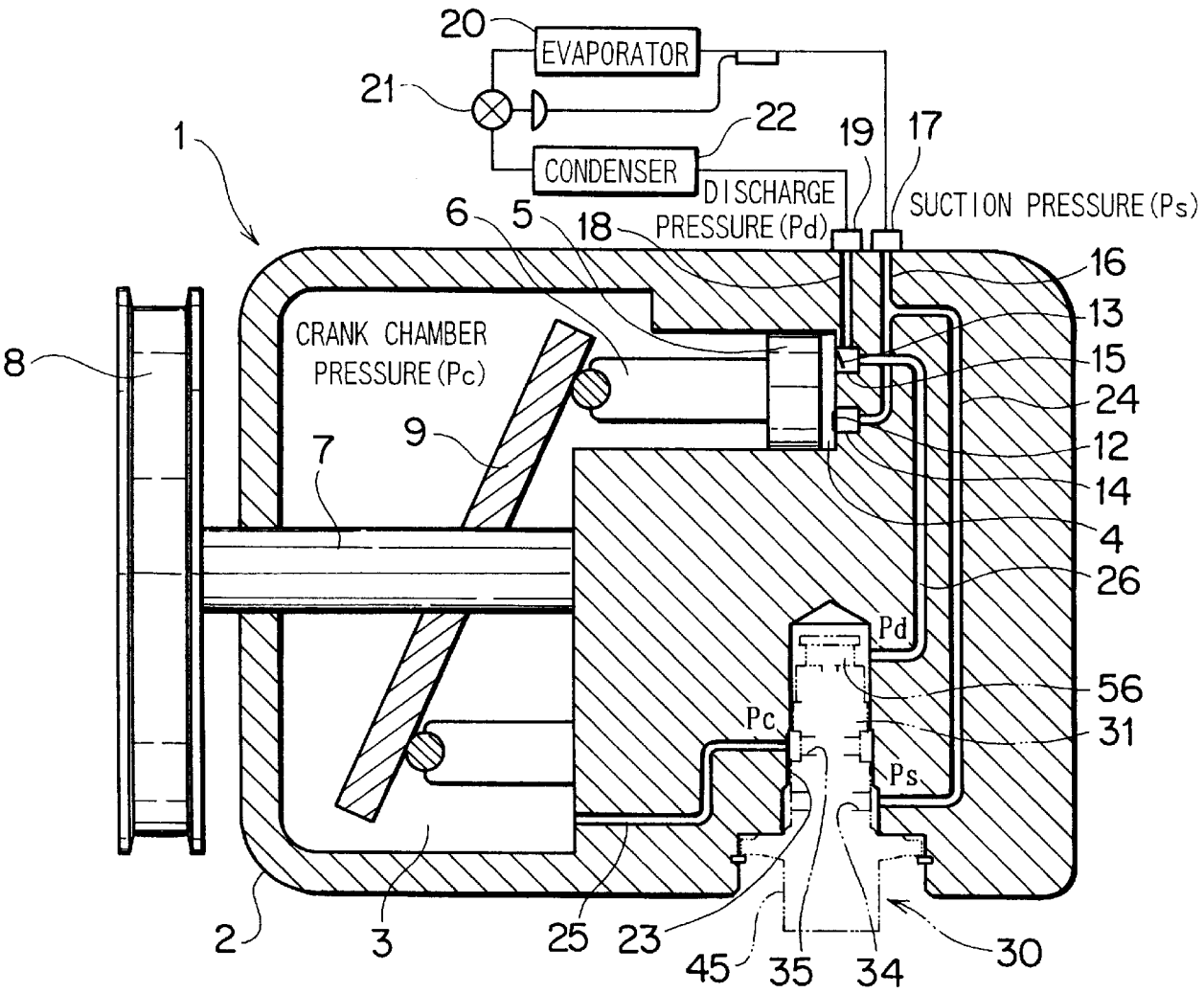
FIG. 1 is a sectional view showing an embodiment of a variable displacement compressor having a control valve according to the invention.
Figure 2:
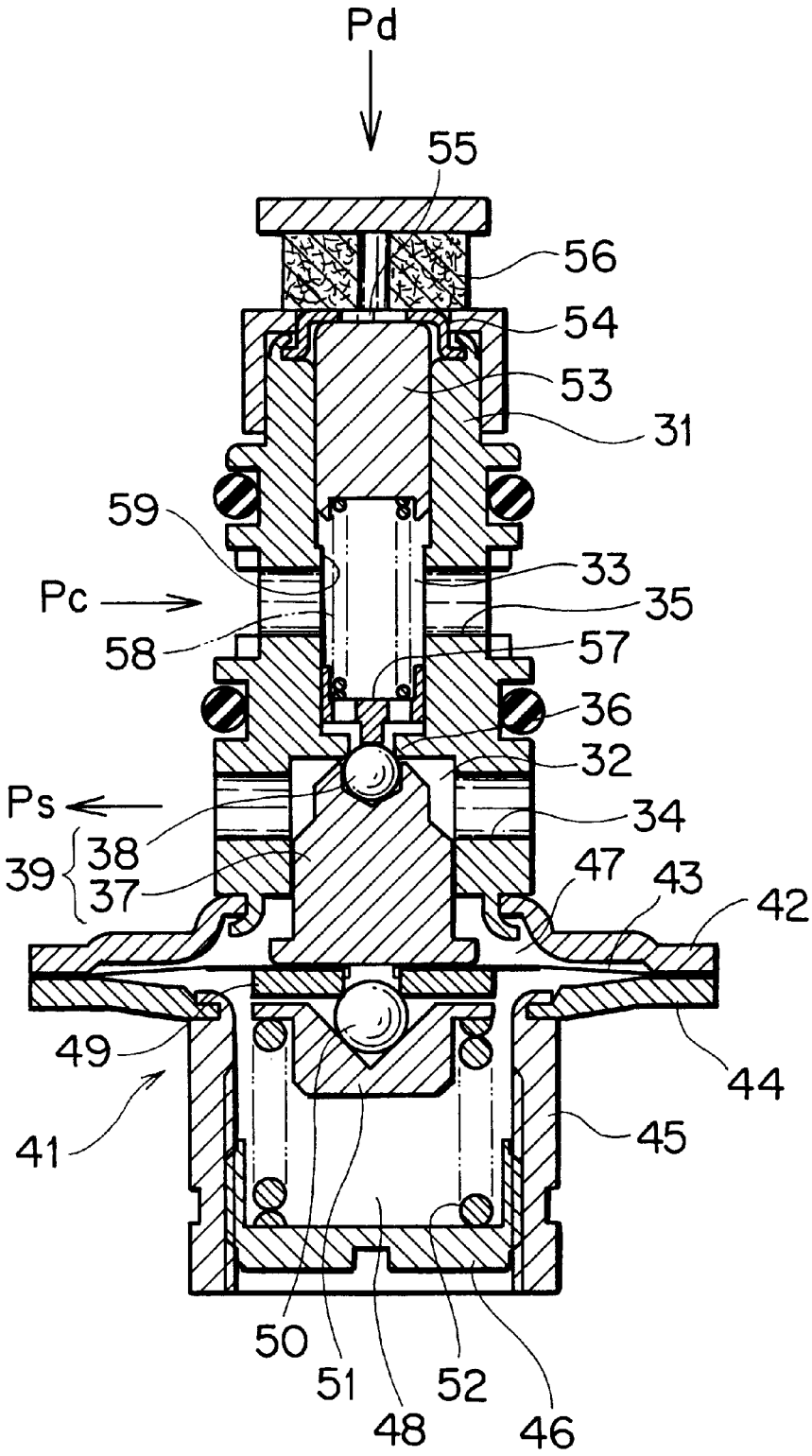
FIG. 2 is a sectional view showing a first embodiment of a control valve according to the invention for a vehicle displacement compressor.

FIG. 1 shows a variable displacement compressor having a displacement control valve embodying the present invention. FIG. 2 shows a first embodiment of the displacement control valve.

The variable displacement compressor 1 of a swash-plate type has a crank chamber 3 defined in a compressor body 2 and has a plurality of cylinder chambers 4 each communicating with the crank chamber 3 at a stroke end thereof. Each cylinder chamber 4 engages axially a slidable piston 5 that is coupled to an end of a piston rod 6 on the side facing the crank chamber 3.

The compressor housing 2 supports rotatively a drive shaft 7 which is rotated through a drive belt (not shown) coupled to a pulley 8 by an engine (not shown).

The drive shaft 7 is joined to a swash plate (inclined plate) 9 within the crank chamber 3 through a conventional connection link (not shown) to be able to vary the mounting angle of the swash plate 9. The swash plate 9 has a surface engaging with the piston rod 6 on the side defining the cylinder chamber 4 so as to exert a axial force of the piston rod 6.

The swash plate 9 that is in an inclined state is rotated through the drive shaft 7. Thereby, the piston 5 of each cylinder chamber 4 reciprocates with a stroke corresponding to an inclined angle of the swash plate 9. The incline angle is automatically adjusted according to a difference between a pressure Pc in the crank chamber and a pressure in a suction pressure (a compressor suction pressure) Ps in each cylinder chamber 4.

The incline angle of the swash plate 9 decreases with increase of the crank chamber pressure Pc, which decreases the stroke of the piston 5. Thereby, the compressor 1 decreases in discharge capacity. On the contrary, the incline angle of the swash plate 9 increases with decrease of the crank chamber pressure Pc, which increases the stroke of the piston 5. Thereby, the compressor 1 increases in discharge capacity until the crank chamber pressure Pc becomes substantially equal to the suction pressure Ps to bring the compressor 1 in a full load state.

Each cylinder 4 has a suction port 14 with a one-way intake valve 12 and has a discharge port 15 with a discharge valve 13. The suction port 14 of each cylinder chamber 4 communicates with an intake connection port 17 through an intake passage 16. The discharge port 15 communicates with a discharge connection port 19 through a discharge passage 18. The intake connection port 17 and discharge connection port 19 communicate with a circulating line for a cooling cycle unit including an evaporator 20, and expansion valve 21, a condenser 22, etc.

The compressor housing 2 has a valve recess 23 for receiving a control valve 30 according to the present invention to be secured therein.

The control valve 30 has a cylindrical valve housing 31 mounted in the recess 23.

The valve housing 31 includes a main valve chamber 32, an auxiliary valve chamber 33, a suction pressure delivering port 34 opened toward the main valve chamber 33, and a crank chamber pressure delivering port 35 opened toward the auxiliary valve chamber 33, and a main valve port 36 disposed between the main valve chamber 32 and the auxiliary valve chamber 33.

The main valve chamber 32 has a main valve element movable vertically. The main valve element 39 consists of a ball 38 and a ball retainer 37 holding the ball. The ball 38 of the valve element 39 opens and closes the main valve port 36 to allow or to shut down a flow communication between the suction pressure delivering port 34 and the crank chamber pressure delivering port 35.

The housing 31 has a lower end which is positioned in the open side of the valve receiving recess 23 of the compressor body 2. On the lower end of the housing 31, there is mounted a diaphragm unit 41 which is a pressure actuated unit that is externally exposed from the valve receiving recess 23.

The diaphragm unit 41 has a saucer-shaped upper cover 42 snap-fitted on the lower end of valve housing 31, a saucer-shaped lower cover 44 joined to the upper cover 42 with a diagram 43 sandwiched therebetween, a cylindrical spring accommodating case 45 snap-fitted on the lower cover 44, and an adjusting screw 46 screwed in the spring accommodating case 45.

On one side of the diaphragm 43, there is defined a diaphragm chamber 47 facing to the valve housing 31. In the other side of the diaphragm 45, there is defined a closed chamber 48 facing the spring case 45. The diaphragm 43 is joined to the main valve 39 on the side defining the diaphragm chamber 47.

At the side of the diaphragm 43 defining the closed chamber 48, there are sequentially disposed an abutment plate 49, a ball 50, and a spring retaining member 51. Between the spring retaining member 51 and the adjusting screw 46, there is arranged a compression coil spring 52 resiliently biasing the main valve element 39 toward the valve closing position (upward) through the diaphragm 43 and the ball retainer 37.

The diaphragm chamber 47 communicates with the suction pressure delivery port 34 of the main valve chamber 32 through a clearance (not shown) between the valve housing 31 and the ball retainer 37 to provide a suction pressure Ps to the suction pressure delivering port 34.

In the auxiliary valve chamber 33, there is disposed a leak flow adjustment valve 53 that is a slide valve slidably engaging with a valve receiving recess defined in the chamber 33. An end cap 54 snap-fitted on an upper end portion of the valve housing 31 has a discharge pressure delivery port 55. A discharge pressure Pd delivered to the discharge pressure delivery port 55 exerts a force on the leak flow adjustment valve 53 in the valve closing direction (downward). A crank chamber pressure Pc delivered to the crank chamber pressure delivering port 35 provides a force the leak flow adjustment valve 53 in the valve opening direction (upward). The end cap 54 has an air filter 56 attached thereto.

The auxiliary valve chamber includes a movable retainer 57 for supporting an auxiliary compression coil spring 58 sandwiched between the retainer 57 and the leak flow adjustment valve 53. The auxiliary spring 58 resiliently biases the leak flow adjustment valve 53 toward the open position and resiliently biases the main valve 39 toward the open position through retainer 57.

The leak flow adjustment valve 53 receives a force acting toward the valve closed position by a differential pressure $\Delta P$ (that is, Pd−Pc) between the discharge pressure Pd and the crank chamber pressure Pc. The leak flow adjustment valve 53 also receives another force acting toward the valve open position by the auxiliary spring 58. The combination of the forces moves the valve element of the leak flow adjustment valve 53 between the fully opened position illustrated in FIG. 3A and the closed position illustrated in FIG. 3C. In the closed position, the valve element abuts against an auxiliary valve seat 59 disposed in the auxiliary valve chamber 33. The leak flow control valve 53 has a leak flow passage 60 defined between an outer surface of the valve and an inner surface of the auxiliary valve chamber 33. A travel of the valve toward the valve open position decreases the passage length L of the leak flow passage 60, adjusting the rate of the leak flowing from the discharge pressure delivery port 55 to the crank chamber delivery port 35 substantially proportionally to the open degree of the leak flow valve.

If the crank chamber pressure Pc is assumed to be substantially constant, the flow adjustment valve 53 primarily responds to the discharge pressure Pd. Thus, the leak flow rate increases with decrease of the discharge pressure Pd.

Such configured control valve 30 is inserted and secured in a valve receiving recess 23 of the compressor body 2. The suction pressure delivery port 34 communicates with the suction port 14 through an suction pressure passage 24. The crank chamber pressure delivery port 35 communicates with the crank chamber 3 through the crank chamber pressure passage 25. The discharge pressure port 55 communicates with the discharge port 15 through the discharge pressure passage 26. Note that the suction pressure passage 24, the discharge pressure passage 25, and the discharge pressure passage 26 are passages defined in the compressor body 2.

Next, operation of thus configured displacement control valve 30 will be discussed.

The suction pressure Ps of the compressor 1 is delivered from the inlet port 14 to the suction pressure delivery port 34, the main valve chamber 32, and the diaphragm chamber 47 through the suction pressure delivery passage 24. Thereby, the diaphragm unit 41 moves the main valve 39 toward the valve open position.

Since the spring force of the auxiliary spring 58 is substantially constant, the combination of the valve opening force exerted on the diaphragm 43 by the suction pressure Ps and the valve closing spring force due to the compression coil spring 52 opens or closes the main valve 39.

Therefore, when the suction pressure Ps becomes lower than a set pressure (a reference set pressure Pss) determined by the compression coil spring 52, the spring force of the compression coil spring 52 moves upward the main valve 39 toward the valve closed position to close the main valve port 36.

The closing of the main valve port 36 interrupts communication of the suction port 34 with the crank chamber 3, thereby increasing the crank chamber pressure Pc so that the compressor 1 becomes in an unload operation state.

Meanwhile, when the suction pressure Ps becomes higher than the reference set pressure Pss, the diaphragm 43 moves downward (in the drawing) against the spring force of the compression coil spring 52. Thereby, the main valve 39 moves toward the valve open position to open the main valve port 36.

The opened main valve port 36 delivers the suction pressure Ps to the crank chamber 3, so that the crank chamber pressure Pc becomes equal to the suction pressure Ps and the compressor 1 operates in a full load condition.

Figure 4:
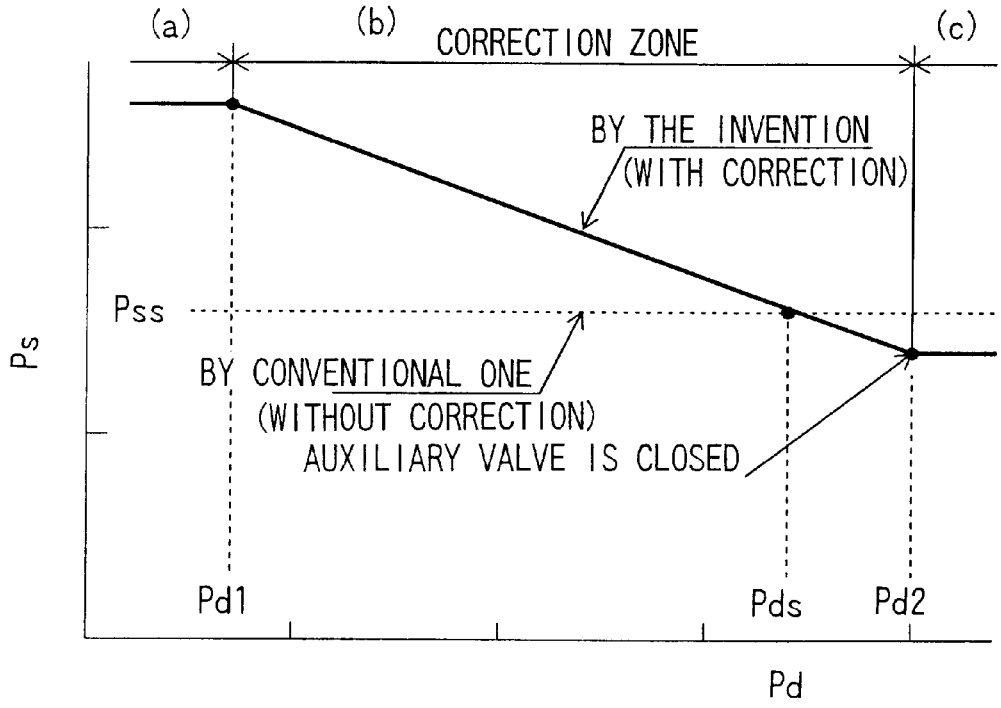
FIG. 4 is a graph showing a specific performance of the control valve of the variable displacement compressor with regard to a discharge pressure and an intake pressure according to the invention.

As described above, when the auxiliary spring 58 is constant in spring force with no correction of the spring force in response to a high discharge pressure, the compressor 1 becomes in a displacement control condition in which the suction pressure Ps becomes constant to be equal to the reference pressure Pss as shown in a chain line in FIG. 4.

Next, an actual operation of the displacement control 30 having the leak flow adjustment valve 53 and the auxiliary valve 58 will be discussed.

Figure 3C:
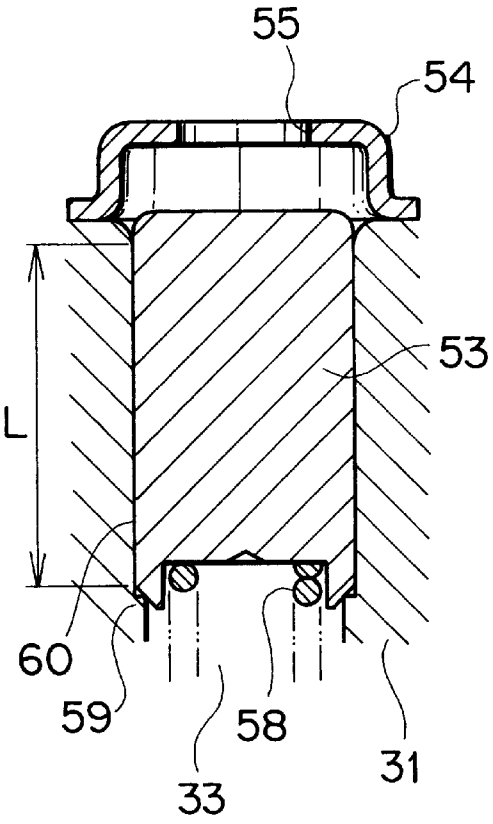
FIGS. 3A to 3C each are parallel enlarged view illustrating an operation of a leak flow adjustment valve assembled in the control valve for the variable displacement compressor.
Figure 3B:
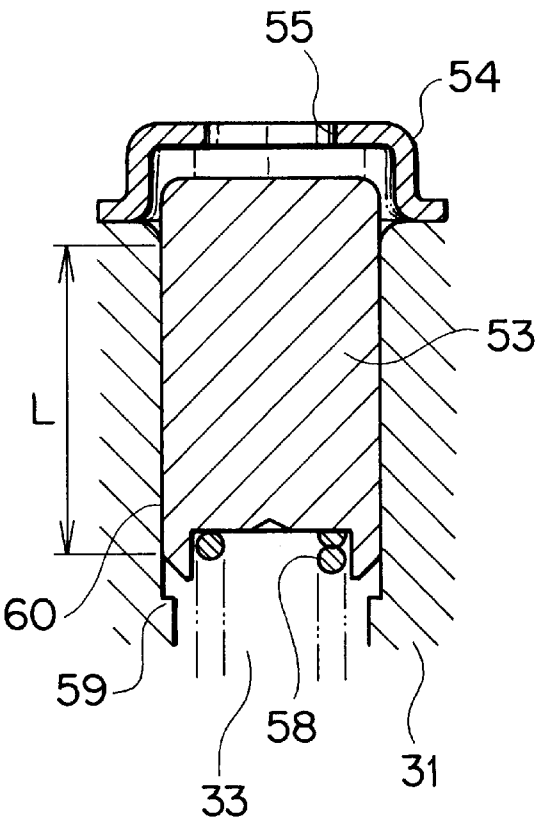
Figure 3A:
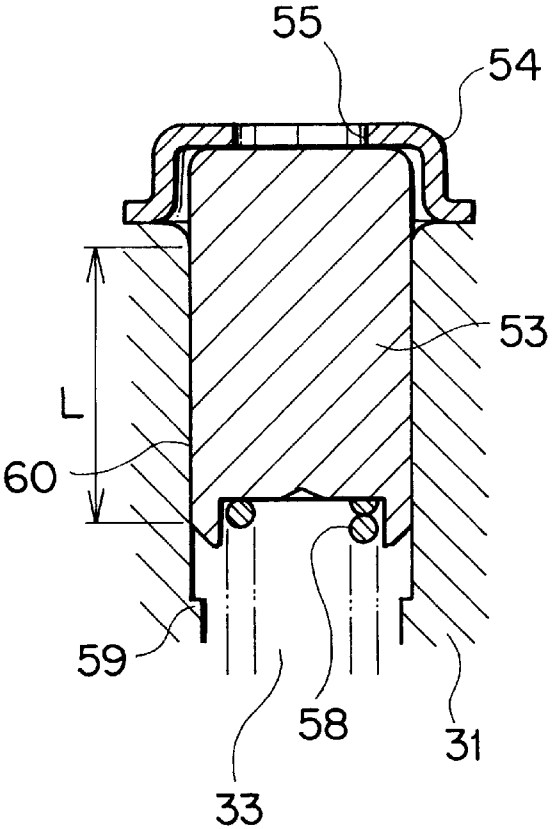

(a) When the discharge pressure Pd is in a lower range ($Pd \leqq Pd1$):

The valve closing force due to the differential pressure $\Delta p$ (that is, Pd−Pc) is lower than an initial force of the auxiliary spring 58 so that the spring force of the auxiliary spring 58 brings the leak flow adjustment valve 53 into its full open condition as illustrated in FIG. 3A.

Thereby, the auxiliary spring 58 keeps a predetermined initial force acting on the main valve 39 toward the valve open position so that a comparatively high constant pressure Ps is required to open the main valve 39 (in a region illustrated in FIG. 4A).

Meanwhile, the leak flow adjustment valve 53 is in its full open state with the passage length L of the leak flow passage 60 being minimum. In this state, the maximum rate leak flows from the discharge pressure delivery port 55 to the crank chamber pressure delivery port 35.

Thereby, when the compressor provides a low discharge pressure, the crank chamber pressure Pc increases. Thus, the displacement control valve keeps the control characteristic for adjusting the crank chamber pressure Pc when the discharge pressure Pd is in the lower range. The control characteristic meets the specific performance of the compressor.

(b) When the pressure Pd is between Pd1 and Pd2 ($Pd1 < Pd < Pd2$):

A force closing the valve due to the deferential pressure $\Delta P$ (that is, Pd−Pc) becomes larger than the initial set force of the auxiliary spring 58. Thereby, the leak flow adjustment valve 53 moves toward the closed position against the spring force of the auxiliary spring 58 as illustrated in FIG. 3B.

This increases the spring force of the auxiliary spring 58 which moves the main valve 39 toward the open position. With the increase of the discharge pressure Pd, the main valve 39 decreases in its open-close switching pressure (in a range illustrated in FIG. 4B). The control characteristic of the displacement control compressor meets the discharge pressure Pd that is responsive to a load condition of a system including the compressor.

Meanwhile, the leak flow adjustment valve 53 moves from the full open position toward the closed position. The increase of the travel distance of the control valve 53 increases the passage length L of the leak passage 60, decreasing the rate of the leak flowing from the discharge pressure delivery port 55 to the crank chamber pressure delivery port 35.

Thus, with increase of the discharge pressure Pd, the leak flow rate decreases, so that the crank chamber pressure Pc is adjusted in an appropriate value by applying the discharge pressure Pd. Therefore, the characteristic of the control valve meets the performance of the compressor.

(c) When the discharge pressure is higher than Pd2 ($Pd \geqq Pd2$):

A force acting toward the value closed position by the deferential pressure $\Delta P$ (that is, Pd−Pc) becomes larger than the initial spring force of the auxiliary spring 58. The leak flow adjustment valve 53 engages with the auxiliary valve seat 59 against the spring force of the auxiliary spring 58 to be in the closed state as illustrated in FIG. 3C.

Thereby, the auxiliary spring 58 exerts a maximum force (a constant load) on the main valve 39 toward the valve open position, and a comparatively low constant pressure Ps is required to open the main valve 39 (in a region illustrated in FIG. 4C).

In addition, the leak flow adjustment valve 53 has been in the closed position so that a minimum leak flows from the discharge pressure delivery port 55 of the leak passage 60 to the crank chamber delivery port 35. This decreases a pressure loss in a high pressure discharge state of the compressor.

A Second Embodiment

Figure 5:
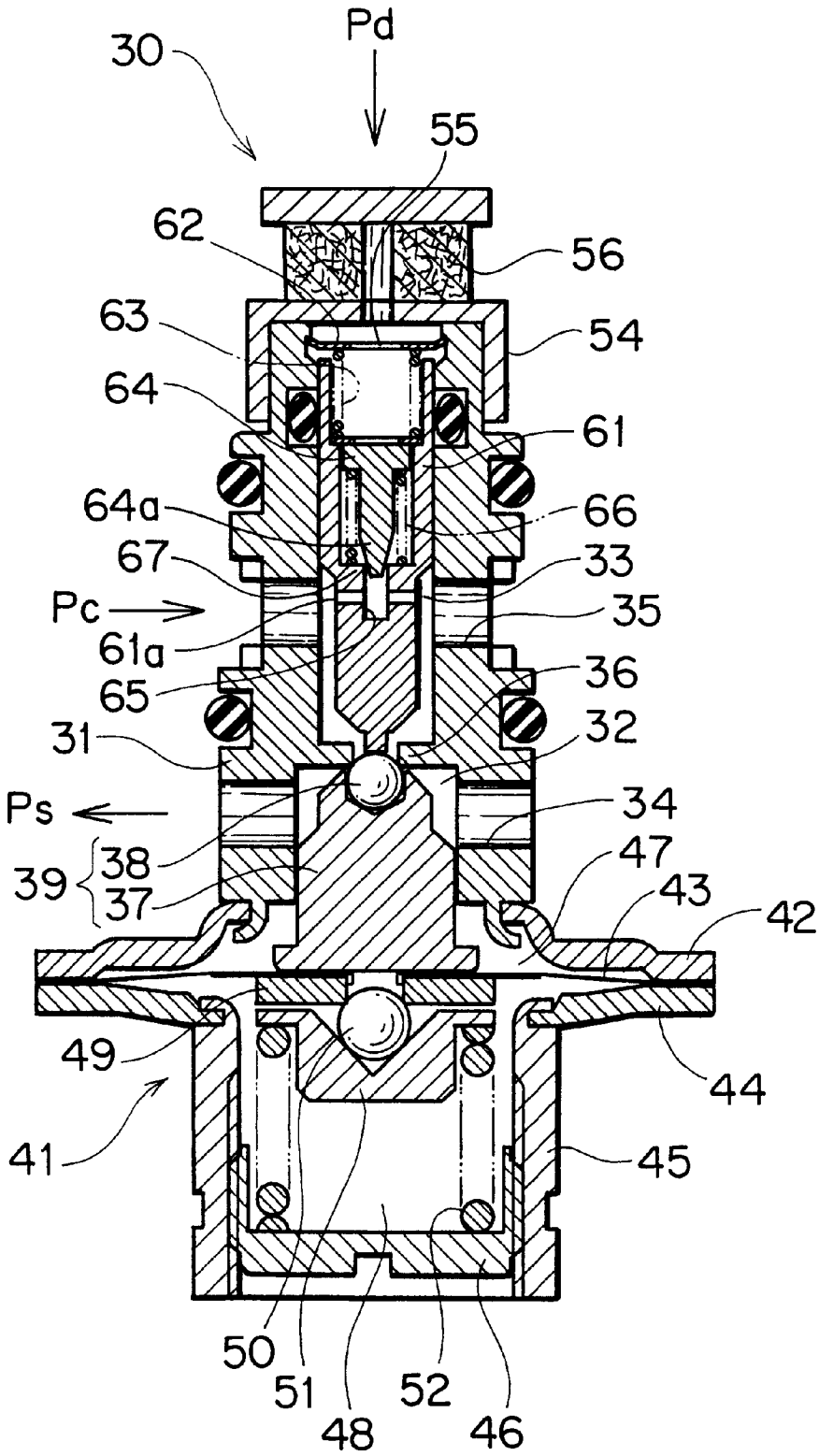
FIG. 5 is a sectional view showing a second embodiment of a control valve according to the invention for a variable displacement compressor.

FIG. 5 shows a second embodiment of a displacement control valve according to the invention. In FIG. 5, the same components as those shown in FIG. 2 are denoted by the same reference numerals and are not discussed again.

The auxiliary valve chamber 33 receives slidably auxiliary biasing unit 61. The auxiliary biasing unit 61 receives a downward force by the discharge pressure Pd delivered to the discharge pressure delivery port 55 and an upward force due to the crank chamber pressure Pc delivered to the crank chamber delivery port 35. Thus, the auxiliary biasing unit 61 exerts a force due to the differential pressure $\Delta P$ (that is, Pd−Pc) between the discharge pressure Pd and the crank chamber pressure Pc on the main valve 39 toward the valve open position.

The auxiliary biasing unit 61 is resiliently biased toward the main valve 39 by a compression coil spring (a biasing spring) 63 disposed between the biasing unit 61 and a retainer ring 62 secured to the valve housing 31. Thus, the auxiliary biasing unit 61 exerts a force on the main valve 39 toward the valve open position according to the spring force of the compression coil spring 63 and the differential pressure $\Delta P$ between Pd and Pc.

Note that since the crank chamber pressure Pc is substantially constant, the auxiliary biasing unit 61 responds primarily to the discharge pressure Pd. Hence, the discharge pressure Pd provides a force on the main valve 39 toward the valve open position.

The auxiliary biasing unit 61 is assembled in the leak flow adjustment valve 64. The leak flow adjustment valve 64 has a conical head 64*a* and is a variable orifice valve increasing an effective open sectional area of the leak flow control port 65 in response to the valve open degree (valve lift degree). The discharge pressure Pd delivered to the discharge pressure 55 exerts a downward force on the leak flow adjustment valve 64 toward the closed position. The crank chamber pressure Pc delivered to the crank chamber pressure delivery port 35 exerts an upward force on the leak flow adjustment valve 64 toward the valve open position through a passage 61*a* defined in the auxiliary biasing unit 61 and through the leak flow control port 65.

Figure 7:
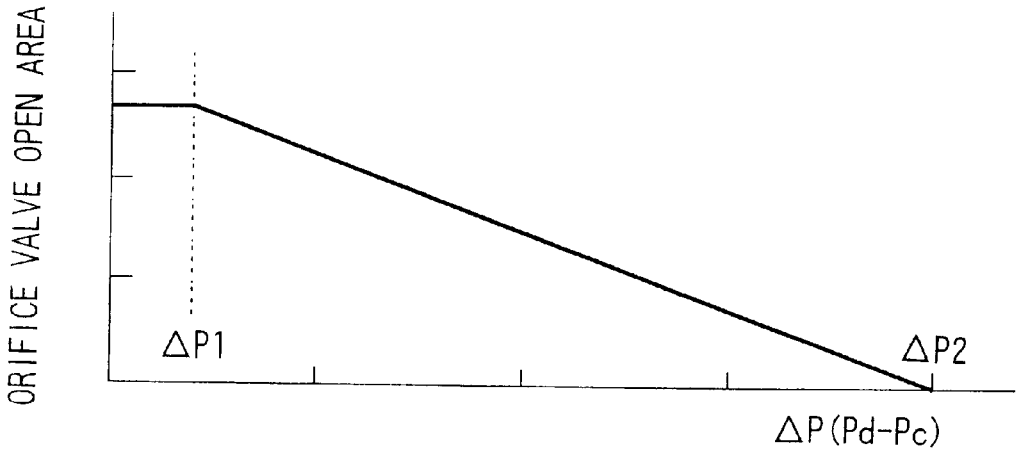
FIG. 7 is a graph showing a specific relation between a differential pressure and an open sectional area of the leak flow adjustment valve in the second embodiment.
Figures 6A, 6B, 6C:
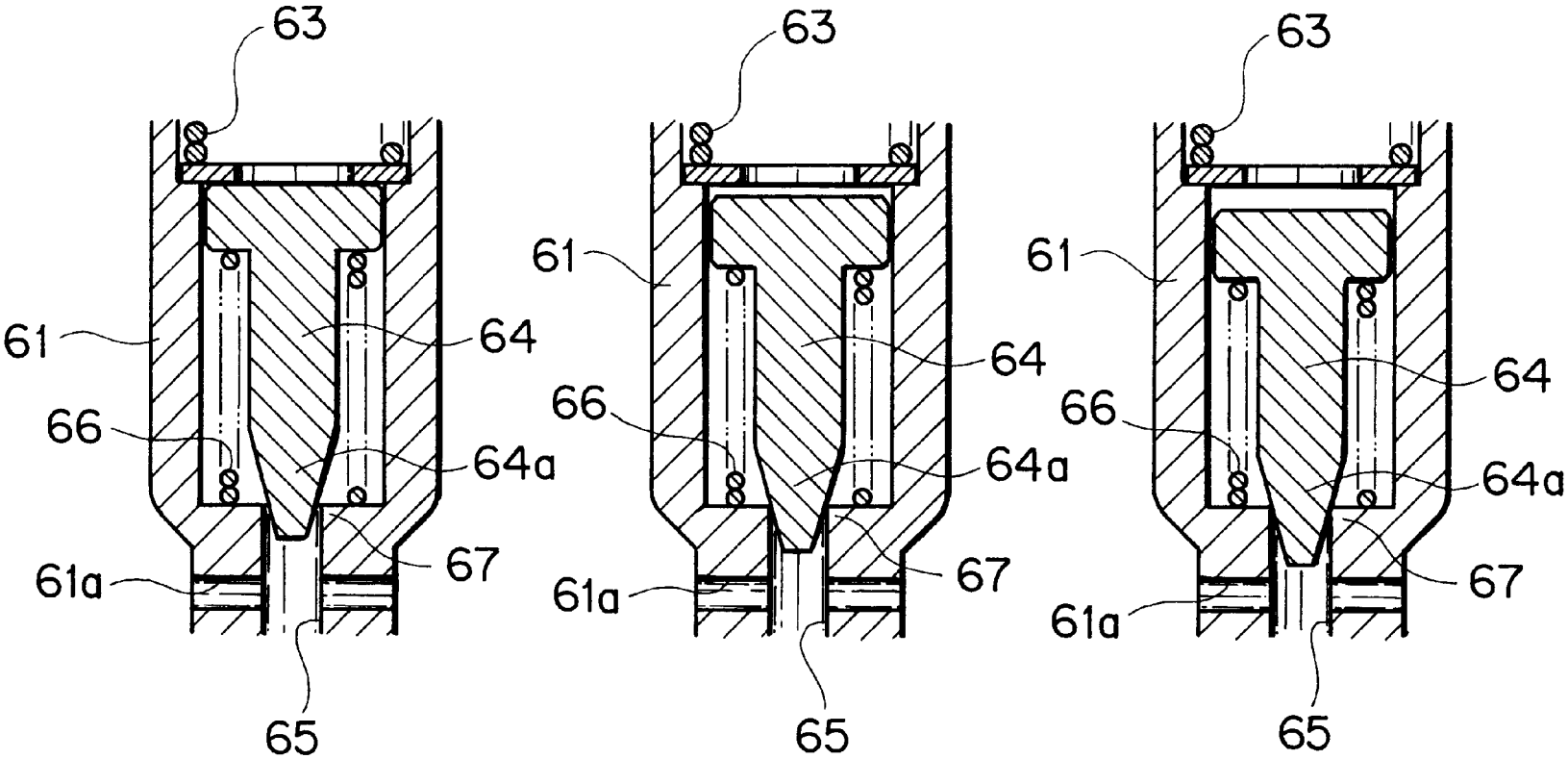
FIGS. 6A to 6C each are a partial enlarged view illustrating an operation of a leak flow adjustment valve assembled in the control valve for the variable displacement compressor in the second embodiment.

The leak flow adjustment valve 64 is resiliently biased by a valve opening spring 66 toward the valve open position. The leak flow adjustment valve 64 receives the spring force of the valve opening spring 66 and a valve closing force due to the deferential pressure ΔP (that is, Pd−Pc) of the discharge pressure Pd and the crank chamber pressure Pc. The combination of the forces moves the leak flow adjustment valve 64 between the full open position in which the valve engages with the retainer ring 62 as illustrated in FIG. 6A and the closed position in which the valve engages with an auxiliary valve seat 67 formed in the auxiliary biasing unit 61 as illustrated in FIG. 6C. This increases the effective open sectional area of the leak flow control port 65 with decrease of the differential pressure ΔP in a way illustrated in FIG. 7.

Note that since the crank chamber pressure Pc is substantially constant, the leak flow adjustment valve 64 primarily responds to the discharge pressure Pd to increase the effective open sectional area of the leak flow control port 65 with decrease of the discharge pressure Pd.

Next, operation of such configured displacement control valve 30 will be discussed.

The main valve 39 receives a correction force through the auxiliary biasing unit 61. The correction force is due to the deferential pressure ΔP (that is, Pd−Pc) multiplied by the pressure receiving area Ah of the auxiliary biasing unit 61. Since the crank chamber pressure Pc is substantially constant, the valve opening force of Ah·Pd relating to the discharge pressure Pd is added to the main valve 39.

Meanwhile, the compression coil spring 52 has been selected to have a spring force corresponding to a reference set pressure Pss when the reference discharge pressure is Pds. Due to the valve opening force of Ah·Pd exerted on the main valve 39, the suction pressure Ps required for opening the main valve increases with decrease of the discharge pressure Pd (when the discharge pressure Pd is lower than the reference discharge pressure Pds), while the suction pressure Ps required for opening the main valve decreases with increase of the discharge pressure Pd (when the discharge pressure Pd is higher than the reference discharge pressure Pds).

These are summarized by the following formula.

$$ps=Pss-Ah(Pd-Pds)/Ad$$

Figure 8:
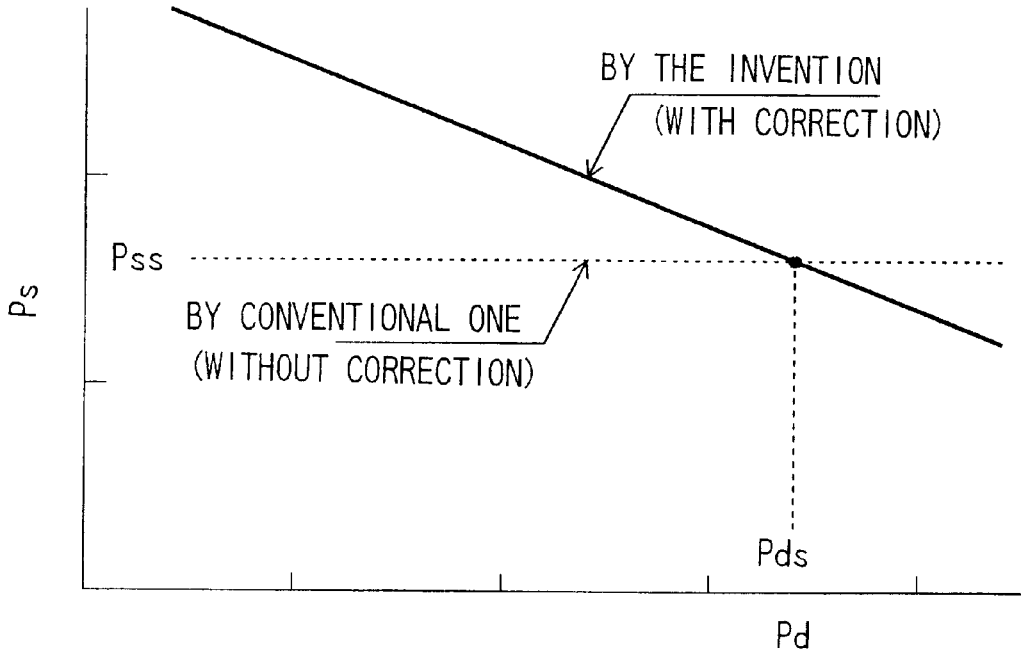
FIG. 8 is a graph showing a discharge pressure relating to an intake pressure of the control valve of the variable displacement compressor according to the invention.

This, as illustrated in a solid line in FIG. 8, achieves the specific control that the suction pressure Ps decreases substantially proportionally to the increase of the discharge pressure Pd. Thereby, the discharge pressure Pd related to a load of a system including the displacement control compressor meets the control characteristic of the compressor.

Next, operation of the leak flow adjustment valve 64 will be discussed.

(a) When the discharge pressure Pd is in a lower state (Pd≦Pd1):

The valve opening force due to the deferential pressure ΔP (that is, Pd−Pc) is not larger than the spring force of the valve opening spring 66, so that the spring force of the valve opening spring 66 moves the leak flow adjustment valve 64 to the full open position as illustrated in FIG. 6A.

Thus, the leak flow control port 65 has a maximum effective flow sectional area to provide a maximum rate of the leak flow flowing from the discharge pressure delivery port 55 to the crank chamber pressure displacement port 35.

As a result, the crank chamber pressure Pc increases in the low state of the discharge pressure Pd. This achieves a specific control of the displacement control valve adjusting the crank chamber pressure during the low state of the discharge pressure Pd, which is appropriate for the specific performance of the compressor.

(b) When the discharge pressure is between Pd1 and Pd2:

The valve closing force due to the deferential pressure ΔP (that is, Pd−Pc) is larger than the spring force of the valve opening spring 66, so that the leak flow adjustment valve 64 moves to the closed position as illustrated in FIG. 6B against the valve opening spring 66.

Thus, the leak flow control port 65 has a decreased effective flow sectional area in response to the movement of the leak flow adjustment valve 64 to provide a decreased rate of the leak flow flowing from the discharge pressure delivery port 55 to the crank chamber pressure delivery port 35.

As a result, the leak flow decreases in response to the increase of the discharge pressure, so that the crank chamber pressure Pc is kept in an appropriate state in response to the discharge pressure Pd. In this pressure range of the discharge pressure Pd, the specific control of the control valve is appropriate for the specific performance of the compressor.

(c) When the discharge pressure Pd is higher than Pd2 (Pd≧Pd2):

The valve closing force due to the deferential pressure ΔP (that is, Pd−Pc) is larger than the spring force of the valve opening spring 66, so that the leak flow adjustment valve 64 engages with the auxiliary valve seat 67 to close it as illustrated in FIG. 6C against the spring force of the valve opening spring 66.

Thus, the leak flow control port 65 provides a minimum rate of a leak flow flowing from the discharge pressure delivery port 55 to the crank chamber pressure delivery port 35. This decreases a pressure loss during the high pressure discharge state of the compressor.

A Third Embodiment

Figure 9:
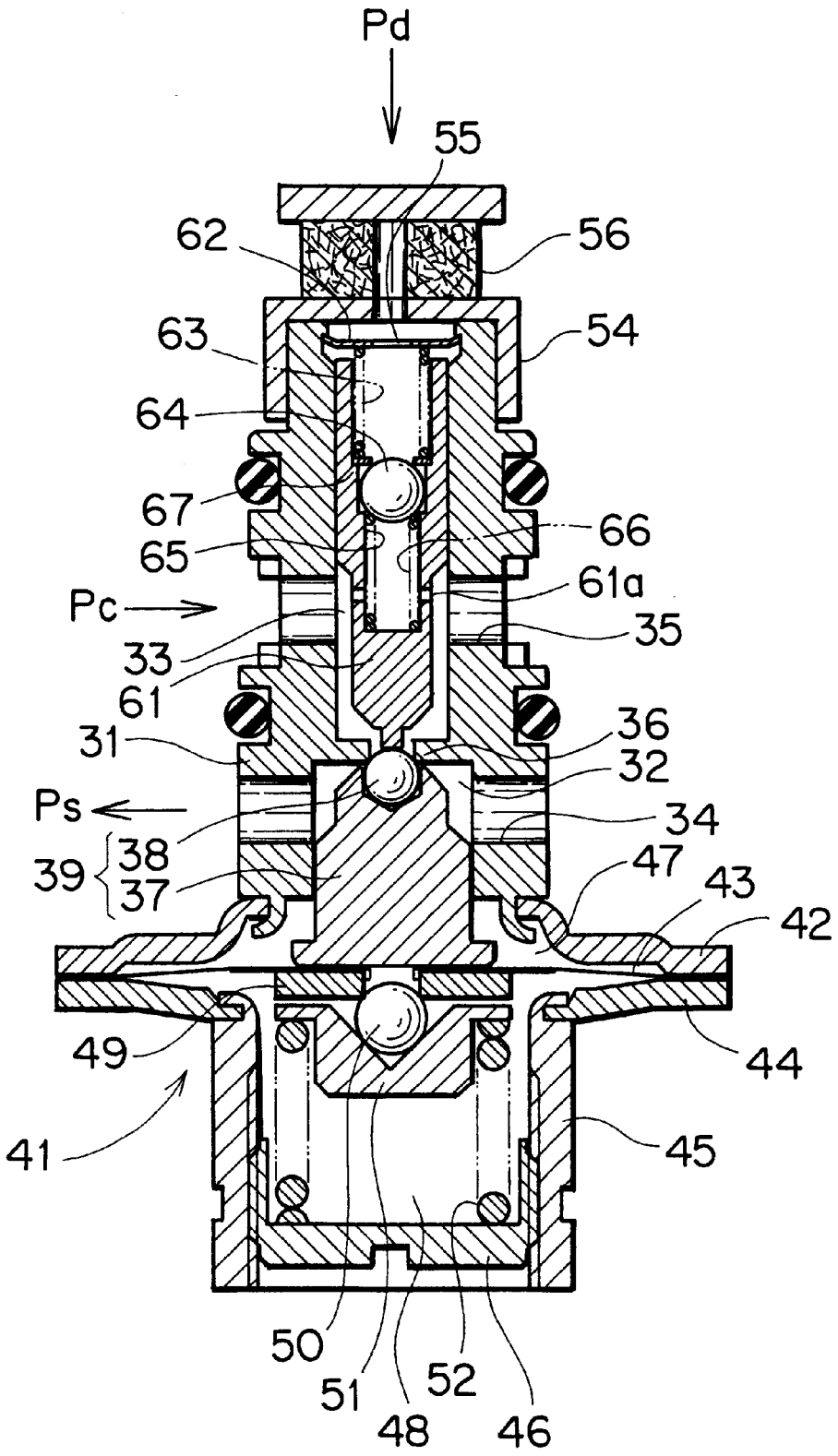
FIG. 9 is a sectional view showing a third embodiment of a control valve according to the invention for a variable displacement compressor.

FIG. 9 shows a third embodiment of a displacement control valve according to the invention. The same components as those shown in FIG. 5 are denoted by the same reference numerals and are not discussed again.

Figure 10:
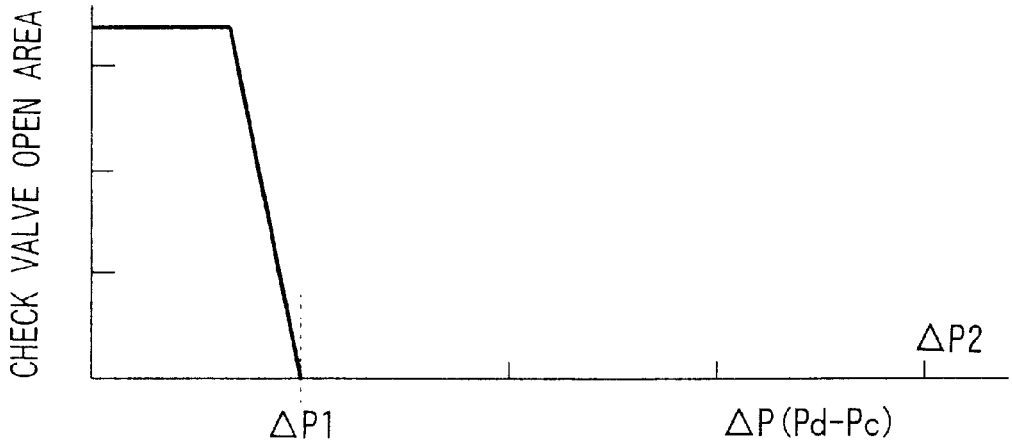
FIG. 10 is a graph showing a specific relation between a differential pressure and an open sectional area of a leak flow adjustment valve in the third embodiment.

The third embodiment includes a check valve having an on-off operation characteristic illustrated in FIG. 10 in place of the variable orifice valve as the leak flow adjustment vale 64 assembled in the auxiliary biasing unit 61.

The auxiliary biasing unit 61 of the third embodiment provides the same modification on the main valve 39 in the open-close operation as the second embodiment. As is similar to the control characteristic shown by a solid line in FIG. 8, the auxiliary biasing unit 61 achieves the specific control that the suction pressure Ps decreases substantially proportionally to the increase of the discharge pressure Pd. The discharge pressure Pd related to a load of a system including the displacement control compressor meets the control character of the compressor.

When the discharge pressure Pd is in a lower state, the valve opening force due to the deferential pressure ΔP (that is, Pd−Pc) is not larger than the spring force of the valve opening spring 66, so that the spring force of the valve opening spring 66 moves the leak flow adjustment valve 64 to the full open position.

Thus, the leak flow control port 65 opens to provide a maximum rate of the leak flow flowing from the discharge pressure delivery port 55 to the crank chamber pressure delivery port 35.

As a result, the crank chamber pressure Pc increases in the low state of the discharge pressure Pd. This achieves a specific control of the displacement control valve adjusting the crank chamber pressure during the low state of the discharge pressure Pd, which is appropriate for the specific performance of the compressor.

In a higher state of the discharge pressure Pd, when the valve closing force due to the deferential pressure ΔP (that is, Pd−Pc) becomes larger than the spring force of the valve opening spring 66, the leak flow adjustment valve 64 engages with the auxiliary valve seat 67 to close it against the spring force of the valve opening spring 66.

Thus, the leak flow control port 65 provides a minimum rate of a leak flow flowing from the discharge pressure delivery port 55 to the crank chamber pressure delivery port 35. This decreases a pressure loss during the high pressure discharge state of the compressor.

In any of the aforementioned embodiments, the pressure actuated unit has been the diaphragm unit 41. However, the pressure actuated unit may be a bellows of a closed structure or the like. A fourth embodiment of a control valve having such a closed bellow to modify the first embodiment of the control valve for the variable-displacement-type compressor.

A Fourth Embodiment

Figure 11:
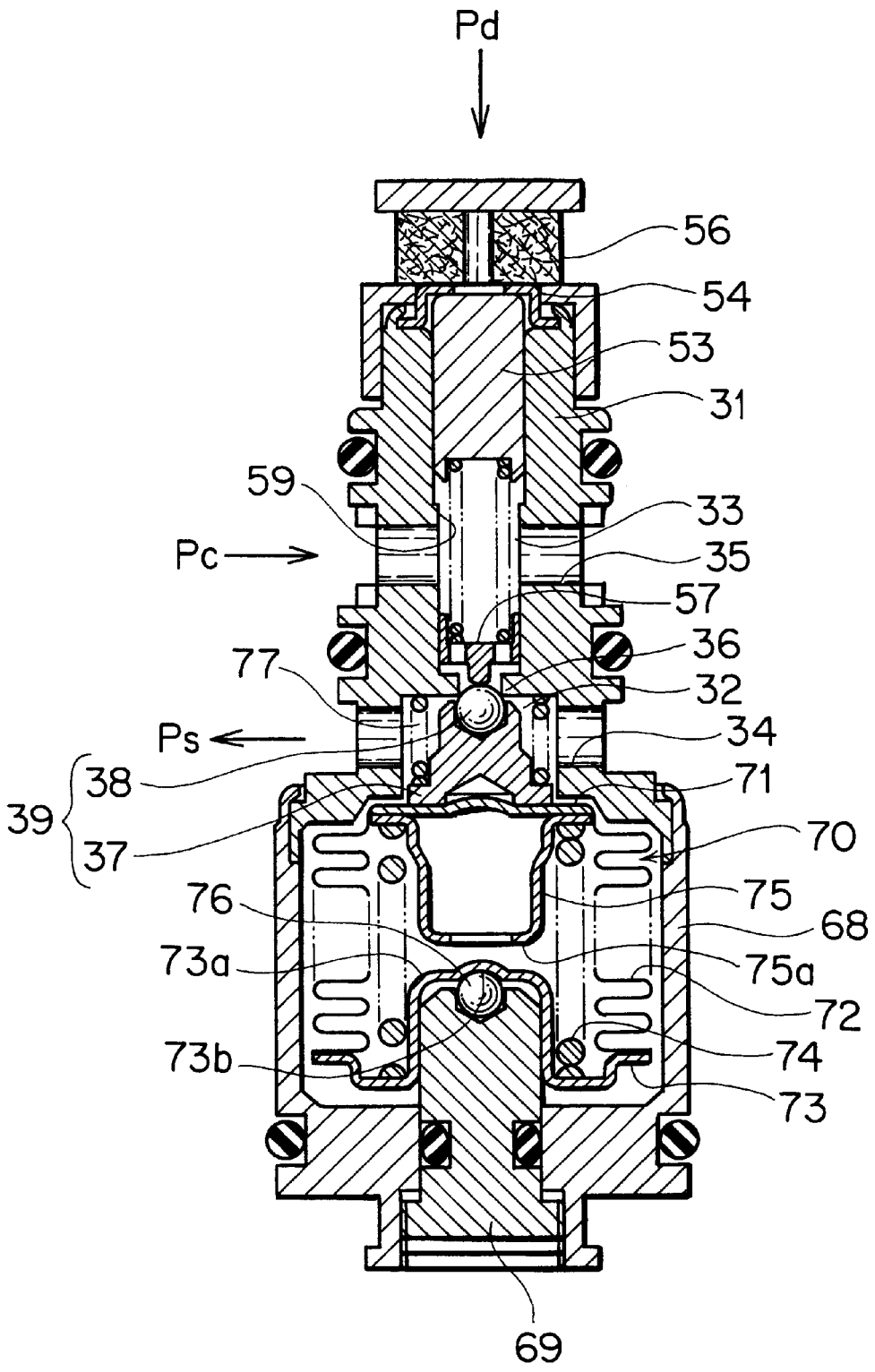
FIG. 11 is a sectional view showing a fourth embodiment of a control valve according to the invention for a variable displacement compressor.

FIG. 11 shows a fourth embodiment of a displacement control valve according to the invention. The same components as those shown in FIG. 2 are denoted by the same reference numerals and are not discussed again.

In the fourth embodiment, the pressure actuated unit includes a closed bellows 70. The bellows 70 is mounted in a bellows accommodation case 68 secured to the valve housing 31. The bellows 70 has a bellow body 72 unitarily provided with an end plate 71 and has another end plate 73 closing the other end thereof. The bellow body 71 is under a negative inside pressure. Within the bellow body 72, there is disposed an abutting plate 75 adjacent to the end plate 71. Between the abutting plate 75 and the end plate 73, there is mounted a compression spring 74 resiliently biasing the abutting plate 75 and the end plate 73 to part them, that is, in the expansion direction (or the valve closing direction) of the bellows 70. The abutting plate 75 has a stopper surface 75*a* abutting against an opposing surface 73*a* of the end plate 73 to limit the maximum contraction movement of the bellows 70.

The bellow accommodation case 68 has an adjustment screw 69 screwed therein. The adjustment screw 69 supports one end of the bellows 70 through a ball joint structure consisting of a ball 76 positioned around an axial center line of the adjustment screw 69 and a spherical concave 73*b* defined in the end plate 73 around the center thereof (around the center of the bellows). That is, the bellows 70 and the bellows accommodation case 68 are coupled to each other through the adjustment screw 69 and the ball joint structure.

The end plate 71 of the bellows 70 is abutting against a ball retainer 37 of the main valve 39 so that the expansion and contraction motions of the bellows 70 are directly applied to the main valve 39.

The bellows accommodation case 68 communicates with the suction pressure delivery port 34. The bellows 70 receives the suction pressure Ps delivered to the suction pressure delivery port 34 in the value opening direction. The bellows 70 expands or contracts according to the deferential pressure between the suction pressure Ps and the bellows inner pressure.

In addition, between the ball retainer 37 of the main valve 39 and the valve housing 31, there is mounted a weak compression spring 77 resiliently biasing the main valve 39 toward the open position.

In the fourth embodiment, the leak flow adjustment valve 53, the movable spring retainer 57, the auxiliary spring 58, etc. each have a configuration similar to that described in the first embodiment.

What is claimed is:

1. A control valve for variable displacement compressor comprising:

a valve housing having a communication passage communicating a suction port of said compressor with a crank chamber of said compressor, a main valve provided in said valve housing for opening and closing said communication passage, a spring member resiliently biasing said main valve toward its closed position, and a pressure actuated unit for moving said main valve toward its open position by receiving a suction pressure of said compressor, a leak passage provided in said valve housing for communicating a discharge port of said compressor with said crank chamber, a leak flow adjustment valve disposed in said valve housing for adjusting an open degree of said leak passage and receiving the discharge pressure exerting a force on said leak flow adjustment valve toward its closed position, said lead flow adjustment valve increasing a leak flow rate of a fluid flowing from a discharge port of said compressor to the crank chamber through said leak passage when said compressor provides a lower discharge pressure, and a correction spring disclosed between the main valve and said leak flow adjustment valve, said correction spring resiliently biasing a valve element of said main valve toward its open position, said correction spring increasing in spring force with transfer of a valve element of said leak flow adjustment valve toward its closed position.

2. The control valve set forth in claim 1 wherein said flow adjustment valve is a slide valve slidingly received in a valve receiving recess formed in said valve housing and defines said leak passage between an outer surface of the leak flow adjustment valve and an inner surface of said valve receiving recess, said leak passage becoming shorter with transfer of said leak flow adjustment valve toward its open position, adjusting a leak flow rate of a fluid flowing form the compressor discharge port to the crank chamber substantially proportionally to the open degree of said leak flow adjustment valve.

3. A control valve for variable displacement compressor comprising:

a valve housing having a communication passage communicating a suction port of said compressor with a crank chamber of said compressor, a main valve provided in said valve housing for opening and closing said communication passage, a spring member resiliently biasing said main valve toward its closed position, and a pressure actuated unit for moving said and valve toward its open position by receiving a suction pressure of said compressor, an auxiliary biasing unit disposed in said valve housing and exerting a force on said main valve toward its valve open position by a differential pressure between a discharge pressure of said compressor and a pressure of said crank chamber, a leak passage provided in said valve housing for communicating a discharge port of said compressor with said crank chamber, and a leak flow adjustment valve disposed in said valve housing for adjusting an open degree of said leak passage and receiving the discharge pressure exerting a force on said leak flow adjustment valve toward its closed position, said leak flow adjustment valve increasing a leak flow rate of a fluid flowing from a discharge port of said compressor to the crank chamber through said leak passage when said compressor provides a lower discharge pressure.

4. The control valve set forth in claim 3 wherein said leak flow adjustment valve is a variable flow orifice valve adjusting a leak flow rate of a fluid flowing from said discharge port of said compressor to the crank chamber, the flow rate being substantially proportional to the open degree of said leak flow adjustment valve.

5. The control valve set forth in claim 3 wherein said leak flow adjustment valve is a check valve being open when the discharge pressure of said compressor is lower than a reference pressure.

* * * * *

UNITED STATES PATENT AND TRADEMARK OFFICE

CERTIFICATE OF CORRECTION

PATENT NO. : 6,334,759 B1
DATED : January 1, 2002
INVENTOR(S) : Morio Kaneko et al.

It is certified that error appears in the above-identified patent and that said Letters Patent is hereby corrected as shown below:

Title page,
Under Item [75] Inventors, change the fourth Inventors name from "Ken Suito" to -- Ken Suitou --

Signed and Sealed this

Nineteenth Day of March, 2002

*Attest:*

*Attesting Officer*

JAMES E. ROGAN
*Director of the United States Patent and Trademark Office*